United States Patent [19]

Cassidy

[11] Patent Number: 5,014,905

[45] Date of Patent: May 14, 1991

[54] TAPERED CARTON AND BLANK FOR FORMING IT

[75] Inventor: Benjamin J. Cassidy, Waldwick, N.J.

[73] Assignee: International Paper Company, Purchase, N.Y.

[21] Appl. No.: 597,231

[22] Filed: Oct. 15, 1990

[51] Int. Cl.[5] ..... B65D 5/06; B65D 5/54

[52] U.S. Cl. ..... 229/113; 229/122; 229/193; 229/900

[58] Field of Search ..... 229/113, 122, 900, 108, 229/112, 193, 101

[56] References Cited

U.S. PATENT DOCUMENTS

| | | | |
|---|---|---|---|
| 695,211 | 3/1902 | Keller | 229/122 |
| 1,993,153 | 3/1935 | Eggebrecht | 229/122 |
| 2,374,458 | 4/1945 | Siewart | 229/113 |
| 3,246,829 | 4/1966 | Sexton | 229/122 |

FOREIGN PATENT DOCUMENTS

| | | | |
|---|---|---|---|
| 0580571 | 8/1959 | Canada | 229/193 |

*Primary Examiner*—Stephen Marcus
*Assistant Examiner*—Chris McDonald
*Attorney, Agent, or Firm*—Michael J. Doyle; Walt Thomas Zielinski

[57] ABSTRACT

A tube type carton formed from a unitary blank of paperboard and having at each end closure panels defined by a pair of opposed dust flaps and opposed major and minor closure flaps. The major flaps and two opposite side wall panels of the four side panels are trapezoidal. The remaining two opposite side wall panels are square but of different size. A pair of rectangular interior tucking panels joins one edge of the smaller square side wall panel to the shortest edge of one of the two opposite trapezoidal side wall panels, these interior panels being tucked into the interior of the carton. By virtue of the tucking, the cross-section of the tube is changed from rectangular to trapezoidal. The fully erected configuration of the carton is that of a truncated, right, four-sided, rectangular pyramid. The minor flaps, near the interior tucking panels, are each provided with cut-outs on one of their free edges so that adhesive on the major flaps can contact the two dust flaps nearest the interior tucking panels and thus prevent the smaller square side wall panel and that trapezoidal side wall panel joined to it by the tucking panels from moving away from each other due to the resiliency of the paperboard.

11 Claims, 2 Drawing Sheets

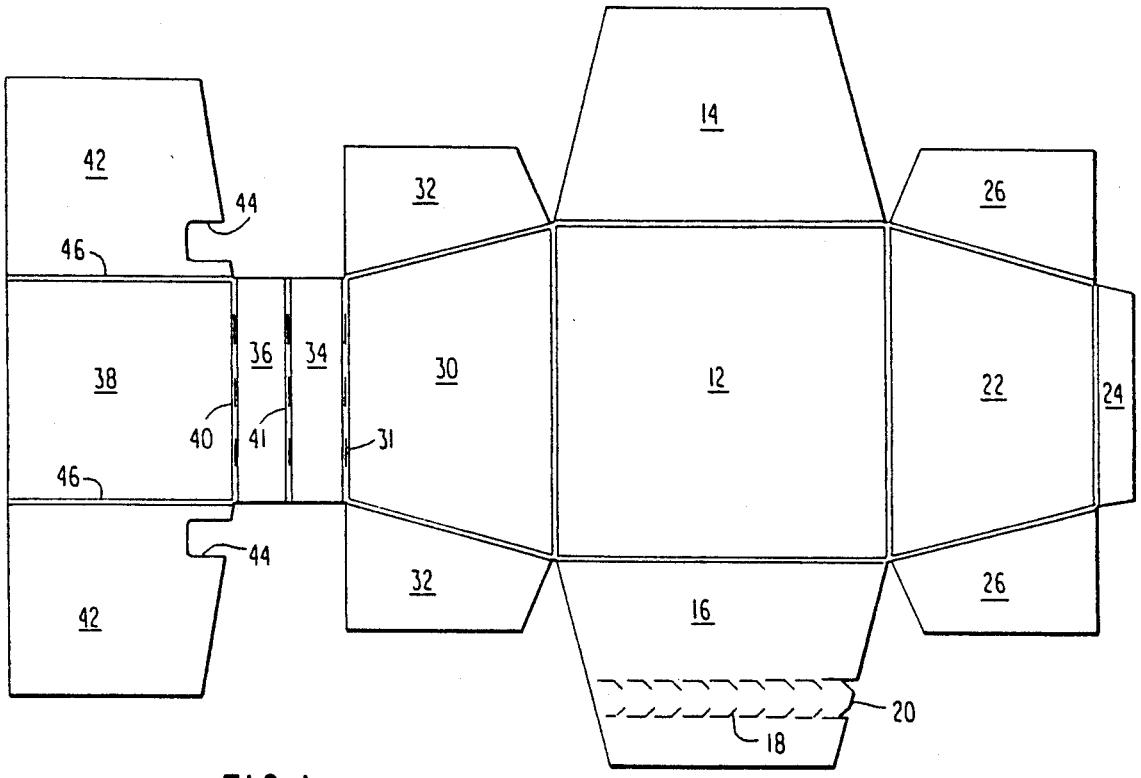
FIG. 1
FIG. 2
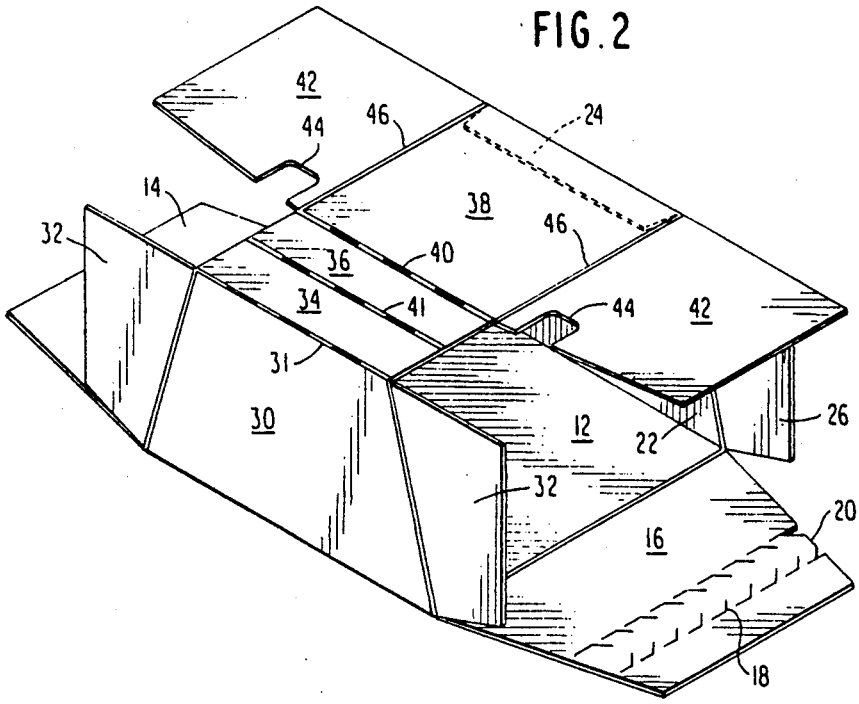

TAPERED CARTON AND BLANK FOR FORMING IT

BACKGROUND OF THE INVENTION

This invention relates to a paperboard container fashioned from a unitary blank of paperboard or other stiff, resilient, and foldable sheet material. The container is in the general form of a truncated, four-sided, right, pyramid, i.e., wherein the top and bottom surfaces of the container are squares of unequal size having a common central orthogonal axis (vertically disposed) and the four sides are trapezoidal.

The prior art is aware of tapered sleeve or truncated pyramidal form containers, such as shown in U.S. Pat. No. 687,968 issued to Reber. However, prior to the present invention, it has not been possible to form such containers on existing automatic machinery.

SUMMARY OF THE INVENTION

According to the practice of this invention, a blank is formed with the usual manufacturer's flap which is glued to another panel or flap so as to form a tube or sleeve having closure flaps at each end. The smaller square surface of the pyramid, being the top panel, is provided at one edge thereof with a pair of rectangular, foldable tucking panels which fold inwardly into the container upon final erection or setting-up. These tucking panels are also integrally connected to the smaller length parallel edge of one of the trapezoidal side panels. The total transverse length of (1) the top of the container and (2) the two tucking flaps or panels is the same as (3) the transverse dimension of the larger or bottom square panel. This permits the initial formation of a tube of rectangular transverse cross-sectional shape and hence susceptible of formation with existing automatic machinery, and also permits the sleeve or tube (termed a preform) to be folded to a flattened configuration for shipment or storage. During final erection or setting up of the carton, the tucking panels are pushed into the interior of the carton. Due to the natural resiliency of the paperboard, such inward tucking results in a force generated by the tucking panels tending to move the trapezoidal side to which the tucking panels are connected away from the interior of the carton. To prevent this, the two opposite minor end closure flaps (the next outermost of the end closure flaps) of the sleeve are each provided with a cut-out. These cut-outs permit adhesive on the interior surfaces of the major closure flaps to contact, through the cut-outs, a respective one of the dust closure flaps carried by one of the trapezoidal side panels. This adhesive contact prevents the bending out of that trapezoidal side panel which is attached to the tucking flaps or panels.

BRIEF DESCRIPTION OF THE DRAWINGS

FIG. 1 is a plan view of a unitary paperboard blank from which the container of this invention is fashioned.

FIG. 2 is a view showing a preform or intermediate stage in the formation of the container, after the manufacturer's flap has been glued.

DETAILED DESCRIPTION OF THE INVENTION

Figure 3:
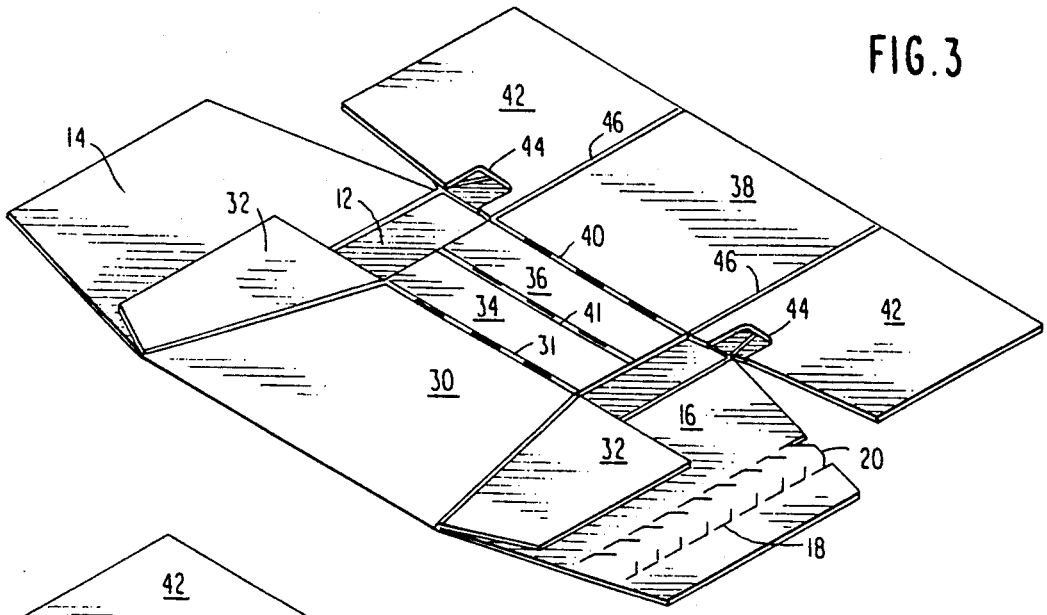
FIG. 3 is a view showing the preform of FIG. 2 in a collapsed form.

Referring now to FIG. 1 of the drawings, the blank includes a series of six panels hingedly joined together by parallel fold or hinge lines. The six panels are a first panel 22, being trapezoidal, a second panel 12 which is square, a third panel 30 which is also trapezoidal and congruent with panel 22, fourth and fifth panels 34 and 36, respectively, and a sixth panel 38 which is square, but is smaller than panel 12. A manufacturer's flap 24 at one edge of panel 22 may be regarded as a seventh panel and is glued to the left, free edge of panel 38 to form a tube or sleeve preform. Panel 22 is provided with a pair of laterally extending end closure, flaps 26, termed dust flaps, foldably connected to panel 22 along the non-parallel side edges of trapezoid 22. Major closure flaps 14 and 16 are provided laterally of second panel 12, with panel 16 provided with a plurality of cuts 18 to define a tear strip 20. The tear strip is of conventional construction, and any specific tear generating configuration of cuts 18 may accordingly be employed. Third panel 30 is also provided laterally with a pair of (dust) end closure flaps 32, the latter joined to third panel 30 along the latter's non-parallel edges, similarly to dust flaps 26. Tucking panels 34 and 36 are rectangular, with panel 34 joined to panel 30 by fold line 31 and panels 34 and 36 coupled by fold line 41. Fold line 40 connects a longer edge of panel 36 to sixth panel 38. Square panel 38 is provided laterally with a pair of minor closure flaps 42, each of the latter provided with a cut-out 44 along a canted free edge thereof. It is seen that cut-outs 44 are adjacent tucking panels 34 and 36.

Figure 4:
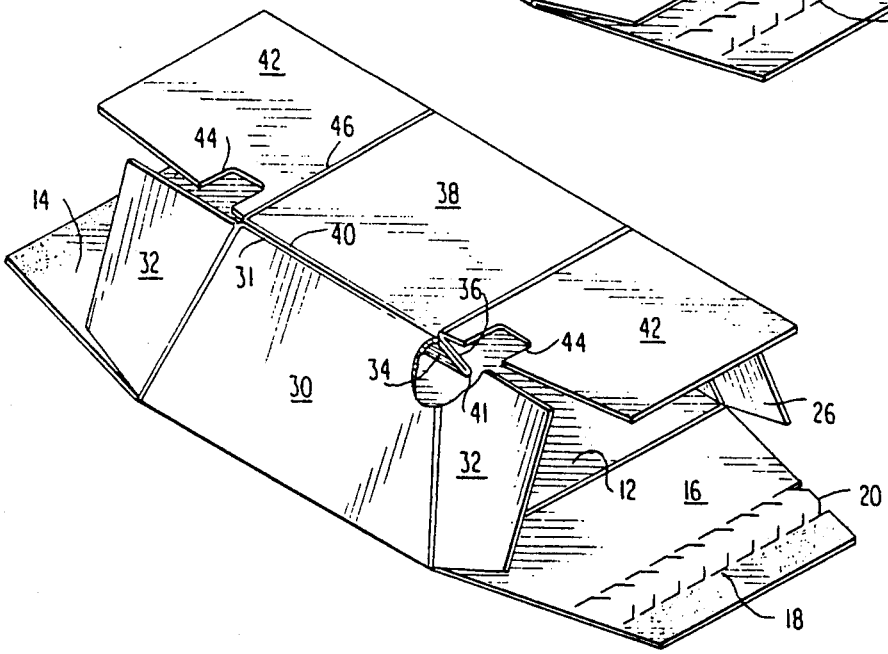
FIG. 4 is a view showing the preform of FIG. 2 having certain of its panels/flaps bent prior to final erection.

Referring now to FIG. 2 of the drawings, the blank has been initially erected to the form of a tube or sleeve by gluing manufacturer's flap 24 to the free, left edge of sixth panel 38. The construction shown at FIG. 2 is termed a preform, and may be considered as four quadrilateral panels connected in series, with 34, 36 and 38 considered as one of these four panels. It will be seen that the total transverse length (measured at right angles to an imaginary longitudinal axis of the tube shown at FIG. 2) of panels 38, 36 and 34 is substantially equal to the transverse length of second or lower panel 12. Similarly, the height as shown in FIG. 2 of trapezoidal panels 30 and 22 is the same, to thereby yield a rectangular transverse cross-section of the tube. This permits the tube to be folded down to a flat storage/shipment condition, as shown at FIG. 3. A consideration of FIG. 2 shows that by pushing in along fold line 41, as by the tip of a thin, elongate member (not shown), tucking flaps 34 and 36 will move into the interior of the tube, so as to permit trapezoidal panels 22 and 30 to move towards each other to thereby yield the desired tapered form of the container. This is shown at FIG. 4. After panels 34 and 36 have been tucked in, there is a force generated by them due to the natural resiliency of the paperboard for panel 30 to swing out, back to the position shown at FIG. 2.

To arrive at the final, erected form of the container, dust flaps 32 and 26 are folded inwardly first to partially close the sleeve ends. Then, minor closure flaps or panels 42 are folded over them, and finally major closure flaps 14 and 16 are folded over panels 42 to form a three layer laminate and thus complete the final erection. A glue strip carried by the inner surfaces of both major closure flaps 14 and 16 adheres to the facing surfaces of minor closure flaps 42. By virtue of cut-outs 44, a part of this adhesive contacts dust flaps 32 carried by panel 30, thus preventing the outward swinging or bulging of panel 30 due to the natural resiliency of tucking flaps 34 and 36 which would as previously noted move panel 30 out away from the interior of the carton. Dust flaps 26 may be omitted, since it is the cooperation between flaps 32, 42, and 16 which prevents outward bulging of panel 30.

Figure 5:
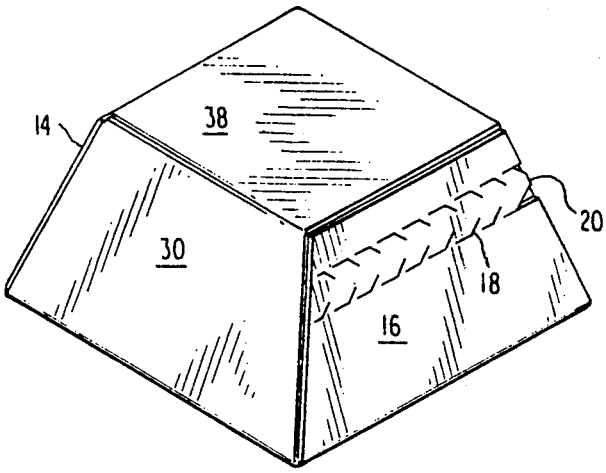
FIG. 5 is a perspective view of the finally erected container.

It is seen that the ends of the preform or sleeve of FIGS. 2 and 4 correspond to opposite side walls of the pyramidal container of FIG. 5.

To open the carton, one end of the tear strip 20 defined by cuts 18 is pulled, as is conventional, to thereby rip through the major closure flap 16 and gain access to the container contents.

The double thickness fold defined by tucking flaps 34, 36 of FIG. 4 serves no specific function in the completed container of FIG. 5. It may be pushed against either panel 30 or 38 so as not to interfere with insertion of the container contents.

What is claimed is:

1. A preform for forming an integral tube type container, the sides of said preform defined by four quadrilateral panels foldably connected in series, each end of the tube having a plurality of end closure flaps, the transverse cross-section of said preform being rectangular, two opposite sides of the tube including square panels of unequal size, the remaining two opposite sides of the tube being trapezoidal panels, the smaller edge of one of said two trapezoidal panels connected to one edge of the smaller square tube side panel by a pair of hinged tucking panels, the transverse length of the smaller square tube side panel plus the transverse length of said two tucking panels being substantially the same as the transverse length of the larger square tube side panels, whereby the preform can be folded so that the side wall panels are overlapping and the preform is substantially flat, the preform being of stiff, resilient and foldable sheet material such as paperboard.

2. The preform of claim 1, wherein said plurality of end closure flaps includes minor flaps, respective opposite edges of said smaller square side panel each being provided with one of said minor closure flaps, each of said minor closure flaps having at least one free edge, said free edge of each of said minor flaps having a cut-out therealong adjacent said tucking panels, and wherein said end closure flaps also include at least one dust flap, each of said dust flaps hingedly joined to a respective non-parallel edge of that trapezoidal tube side panel whose smaller edge is connected to said tucking panels.

3. The preform of claim 2 wherein said plurality of end closure panels includes a pair of major closure flaps, each of said major closure flaps being hingedly secured to respective opposite edges of said larger square tube side panel, said major closure flaps each being trapezoidal.

4. A unitary blank of stiff, resilient, and foldable sheet material, such as paperboard, said blank including six panels serially foldably joined to each other along parallel fold lines, the first panel being trapezoidal, the second panel being square, the third panel being trapezoidal, the fourth and fifth panels being rectangular, and the sixth panel being square, the length of said second panel being substantially equal to the combined length of said fourth, fifth and sixth panels as measured along said panels, the length of said first and third panels being equal, also as measured along said panels.

5. The blank of claim 4 wherein said first, second, third and sixth panels each foldably carry a pair of laterally extending closure flaps.

6. The blank of claim 5 wherein each of said laterally extending closure flaps carried by the sixth panel is provided with a cut-out.

7. The blank of claim 4 wherein said first and third panels are congruent.

8. The blank of claim 4 wherein said second panel is larger than said sixth panel.

9. A container formed from a unitary blank of paperboard, the container being in the form of a four-sided, right, truncated pyramid, the top and bottom panels being squares of different sizes, the sides of said pyramid being trapezoidal, one pair of opposite sides of said pyramid defined by a plurality of overlapping end closure panels, each of the remaining pair of opposite sides of said pyramid defined by a panel of single thickness, a pair of hinged tucking panels extending into the interior of said pyramid from the junction of the shortest edge of one of said single thickness trapezoidal walls and the top panel.

10. The container of claim 9, wherein said plurality of end closure panels includes three laminar panels, a portion of the middle panel thereof having a cut-out, the outermost panel thereof having an adhesive thereon, the adhesive contacting the innermost panel thereof only through said cut-out.

11. The container of claim 10 wherein said cutout is located along a free edge of said middle laminar panel.

* * * * *